US008539646B2

(12) United States Patent
Falvai

(10) Patent No.: US 8,539,646 B2
(45) Date of Patent: Sep. 24, 2013

(54) COUPLING SYSTEMS

(75) Inventor: Mark Falvai, Sausalito, CA (US)

(73) Assignee: Workshop XI, Inc., Sausalito, CA (US)

( * ) Notice: Subject to any disclaimer, the term of this patent is extended or adjusted under 35 U.S.C. 154(b) by 93 days.

(21) Appl. No.: 13/020,061

(22) Filed: Feb. 3, 2011

(65) Prior Publication Data

US 2012/0198667 A1 Aug. 9, 2012

(51) Int. Cl.
*A44B 11/04* (2006.01)

(52) U.S. Cl.
USPC ..... 24/265 BC; 24/265 EC; 24/200

(58) Field of Classification Search
USPC ..... 24/265 EC, 265 BC, 200, 3.12, 3.1, 24/3.11
See application file for complete search history.

(56) References Cited

U.S. PATENT DOCUMENTS

| | | | | |
|---|---|---|---|---|
| 5,248,187 | A | 9/1993 | Harrison | |
| 6,715,188 | B1 * | 4/2004 | Jackson et al. | 24/698.1 |
| 7,340,803 | B2 * | 3/2008 | Howell | 24/198 |
| 7,413,371 | B2 | 8/2008 | Arnold et al. | |
| 2004/0200042 | A1 * | 10/2004 | Howell | 24/194 |
| 2008/0189917 | A1 * | 8/2008 | Maley | 24/197 |
| 2008/0301912 | A1 * | 12/2008 | Maley | 24/114.7 |

FOREIGN PATENT DOCUMENTS

| | | |
|---|---|---|
| EP | 1985509 | 10/2008 |
| JP | 11059327 | 3/1999 |

* cited by examiner

*Primary Examiner* — Robert J Sandy
*Assistant Examiner* — Michael Lee
(74) *Attorney, Agent, or Firm* — Baker & Associates PLLC; Trent Baker

(57) ABSTRACT

One embodiment of the present invention relates to a releasable coupling system comprising a base, a lengthwise member, and a buckle. The lengthwise member is fixably coupled to the base parallel to the lengthwise dimension and substantially medial with respect to the widthwise dimension. The buckle comprises a planar surface and a first and second hooked region extending from the planar surface oriented opposite one another. The first and second hooked regions and the planar surface define a partially enclosed region corresponding to the widthwise dimension and the base rise dimension of the lengthwise member. A gap in the partially enclosed region corresponds to a coupling between the lengthwise member and the base.

20 Claims, 10 Drawing Sheets

COUPLING SYSTEMS

FIELD OF THE INVENTION

The invention generally relates to improved coupling systems. In particular, the present invention relates to a releasable modular coupling system and methods of operation.

BACKGROUND OF THE INVENTION

Coupling systems attach members/components to one another. One type of coupling system is a releasable coupling system that enables a user to repeatedly couple or decouple members from one another. For example, a conventional automobile seatbelt is a releasable coupling system which may be used to secure a passenger in a particular seat. Likewise, a belt is a releasable coupling system for securing pants around a user's waist. Releasable coupling systems include multiple components which are coupled together. An automobile seatbelt includes at least two straps and two intercoupling buckles. Likewise, a belt includes a strap and a buckle.

Releasable coupling systems may be used for a variety of applications, each corresponding to a hierarchy of optimal performance characteristics. For example, releasable coupling systems on outdoor backpacks require both high durability and low weight for optimal performance. In contrast, releasable coupling systems used for securing payload on a truck require high durability and high force tolerance. Additional performance factors include manufacturing cost, appearance, intuitive operation, etc. Therefore, the performance characteristics of certain releasable coupling systems may be more or less optimal for certain applications. For example, a VELCRO snap-lock releasable coupling is beneficial for many lightweight applications including a pocket flap closure system. However, a cam buckle is more appropriate for heavier-weight applications because of its relative weight and force tolerance.

Conventional releasable coupling systems fail to provide optimal performance characteristics for use as a modular soft good releasable coupling system. A modular releasable coupling system is further defined as a releasable coupling system which facilitates efficient intercoupling of a variety of components in addition to the performance characteristics for a releasable coupling system. For example, the military MOLLE (modular lightweight load-carrying equipment) includes a plurality of PAL (pouch attach ladder) straps that facilitate the releasable coupling of various components to a base member. The system is used primarily on military outerwear such as vests and corresponding components in order to facilitate selective intercoupling schemes and accommodate specific functions. Unfortunately, conventional modular releasable coupling systems including the MOLLE system do not optimize performance characteristics for retail applications. For example, the MOLLE system requires numerous unattractive horizontal straps for intercoupling components. In addition, the MOLLE system and other modular systems require a non-intuitive complex coupling method. Further, most existing modular coupling systems do not include buckles, which could be useful for selectively coupling and/or spacing components.

Therefore, there is a need in the industry for an improved coupling system including system components and an intuitive method of operation.

SUMMARY OF THE INVENTION

The present invention relates to improved coupling systems. One embodiment of the present invention relates to a releasable coupling system comprising a base, a lengthwise member, and a buckle. The lengthwise member is fixably coupled to the base parallel to the lengthwise dimension and substantially medial with respect to the widthwise dimension. The buckle comprises a planar surface and a first and second hooked region extending from the planar surface oriented opposite one another. The first and second hooked regions and the planar surface define a partially enclosed region corresponding to the widthwise dimension and the base rise dimension of the lengthwise member. A gap in the partially enclosed region corresponds to a coupling between the lengthwise member and the base. A second embodiment of the present invention relates to a method for releasably coupling a buckle to a base comprising the acts of providing a base, a lengthwise member, and a buckle; coupling the lengthwise member to the base; aligning the buckle with the lengthwise and widthwise dimensions of the lengthwise member; and hooking the buckle over the lengthwise member substantially encircling the lengthwise member, forming a gap corresponding to the coupling between the lengthwise member and the base.

Embodiments of the present invention represent a significant advance in the field of releasable coupling systems. Conventional releasable coupling systems fail to provide all of the performance characteristics of the present invention, including but not limited to modularity, intuitive operation, maximum durability, and minimum weight. In particular, embodiments of the present invention may be used to couple a buckle to a base. The base may be a soft good member such as a garment, carrying device, or load bearing strap. The system may be used for releasable coupling of an individual location such as the releasable closure of a pocket or pouch. The system may also be used as a modular coupling system to facilitate multiple releasable coupling locations. In contrast to many releasable coupling systems (i.e. VELCRO, snap locks, etc.) embodiments of the present invention provide durable releasable coupling that is resistant to incidental compression forces and/or debris accumulation. In addition, components of the present invention are capable of being efficiently manufactured.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

The present invention relates to improved coupling systems. One embodiment of the present invention relates to a releasable coupling system comprising a base, a lengthwise member, and a buckle. The lengthwise member is fixably coupled to the base parallel to the lengthwise dimension and substantially medial with respect to the widthwise dimension. The buckle comprises a planar surface and a first and second hooked region extending from the planar surface oriented opposite one another. The first and second hooked regions and the planar surface define a partially enclosed region corresponding to the widthwise dimension and the base rise dimension of the lengthwise member. A gap in the partially enclosed region corresponds to a coupling between the lengthwise member and the base. A second embodiment of the present invention relates to a method for releasably coupling a buckle to a base comprising the acts of providing a base, a lengthwise member, and a buckle; coupling the lengthwise member to the base; aligning the buckle with the lengthwise and widthwise dimensions of the lengthwise member; and hooking the buckle over the lengthwise member substantially encircling the lengthwise member, forming a gap corresponding to the coupling between the lengthwise member and the base. Also, while embodiments are described in reference to a soft good based releasable coupling system, it will be appreciated that the teachings of the present invention are applicable to other areas.

Figure 1:
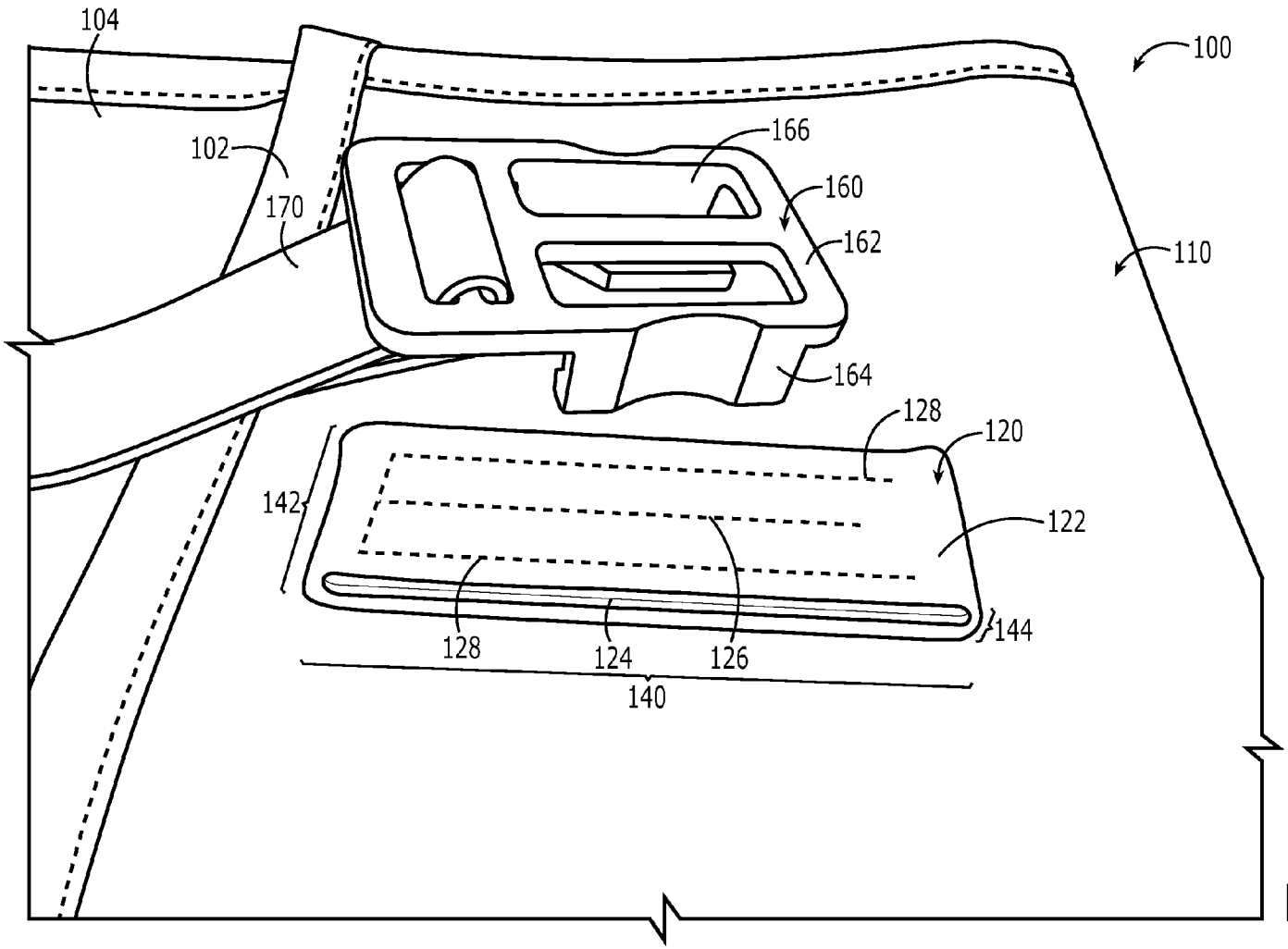
FIG. 1 illustrates a perspective view of a releasable coupling system in a decoupled configuration in accordance with embodiments of the present invention.
Figure 2:
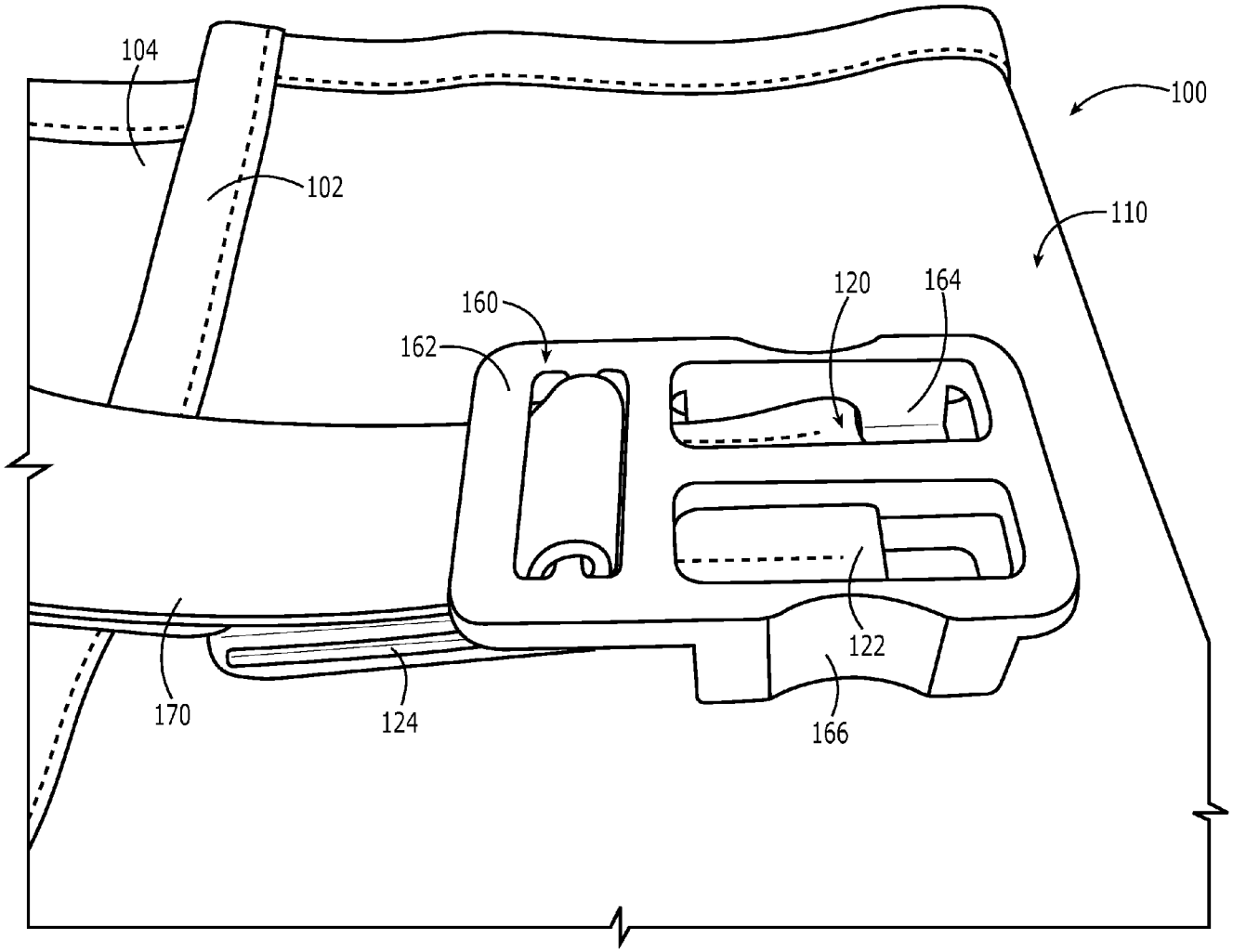
FIG. 2 illustrates a perspective view of the releasable coupling system of FIG. 1 in a partially coupled configuration.
Figure 3:
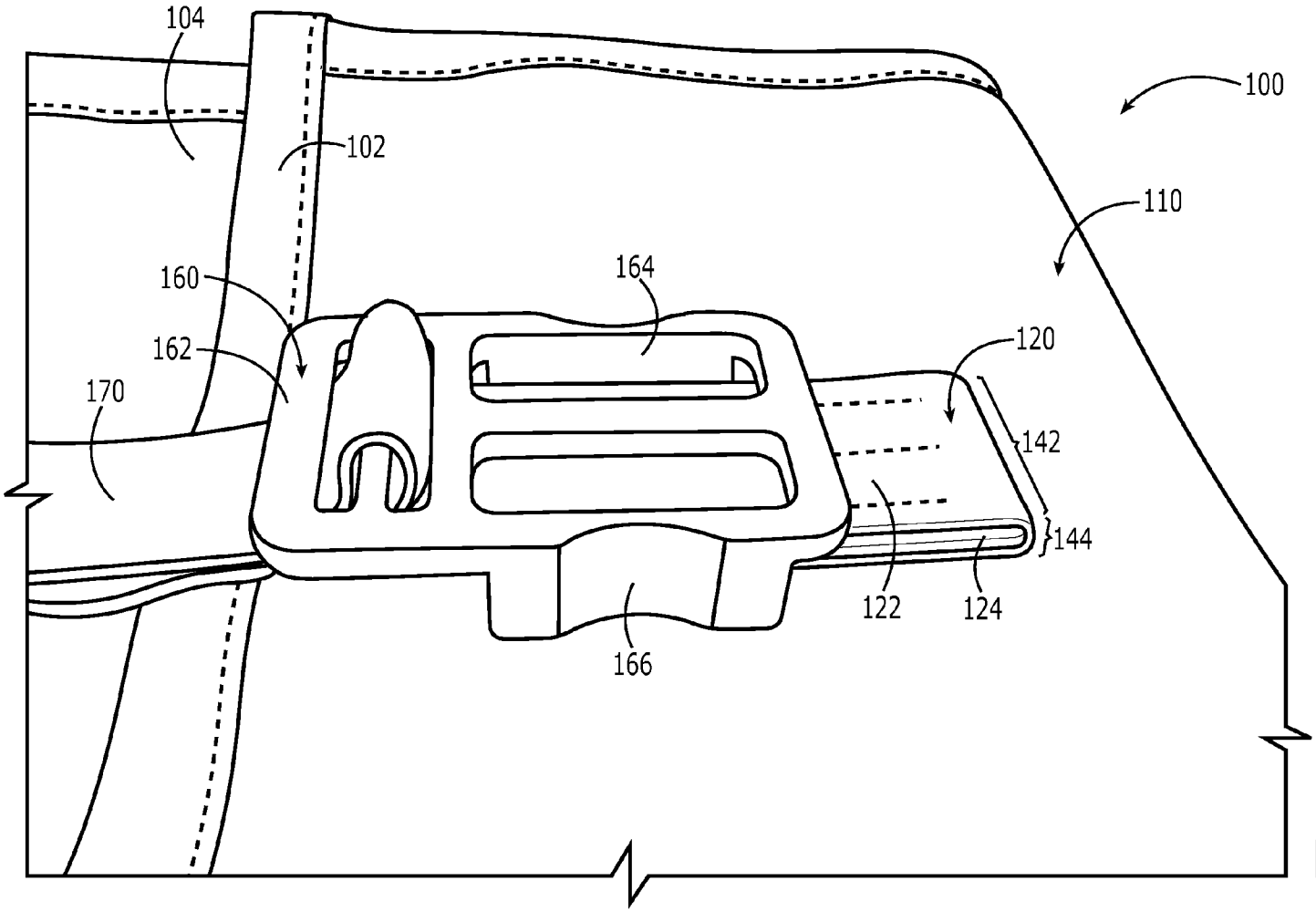
FIG. 3 illustrates a perspective view of the releasable coupling system of FIG. 1 in a coupled configuration.

Reference is initially made to FIGS. 1-3, which illustrate perspective views of a releasable coupling system designated generally at 100. The system 100 includes a base 110, a lengthwise member 120, and a buckle 160. The buckle 160 may be releasably coupled to the base 110 via a coupling method over the lengthwise member 120. The coupling method includes hooking the buckle 160 over the lengthwise member 120, as shown in FIG. 2-3. The coupling method enables the buckle 160 to translate along the lengthwise member 120 while maintaining the releasable coupling. The coupling method and corresponding component structures will be described in more detail below. The base 110 may be any surface upon which the lengthwise member 120 is coupled. Therefore, the releasable coupling system may be used for a wide variety of coupling applications. The illustrated base 110 is a soft good surface comprising a fabric material such as the external surface of a garment, backpack, or strap. The base 110 further includes a base flap 102 and a base bottom 104. The base flap 102 overlaps the base bottom 104.

Figure 4:
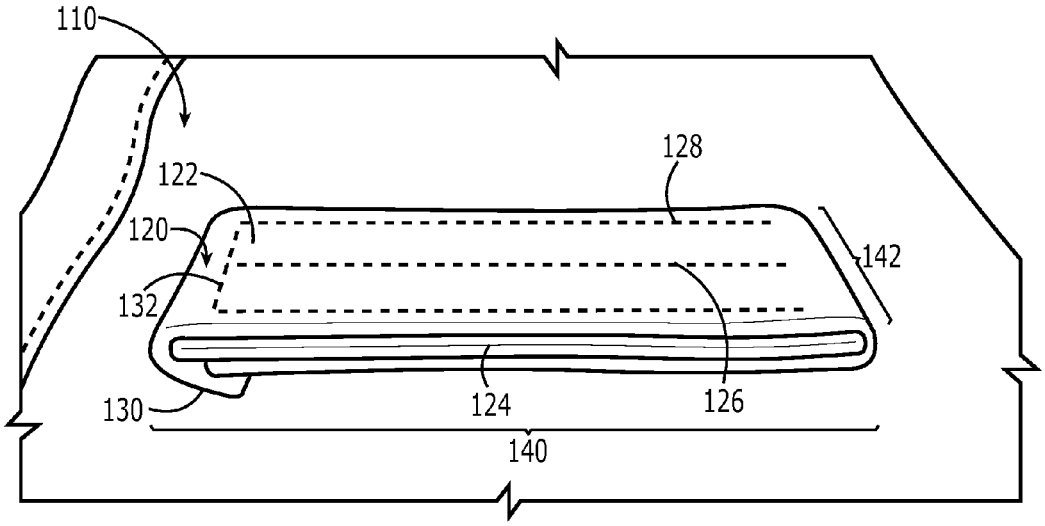
FIG. 4 illustrates a perspective view of the lengthwise member and base components of the releasable coupling system of FIG. 1.

Reference is made to FIG. 4 in addition to FIGS. 1-3 to illustrate details about one embodiment of the lengthwise member 120. The lengthwise member 120 may be any elongated structure coupled to the base 110 in the manner described below. The lengthwise member 120 includes a lengthwise dimension 140, a widthwise dimension 142, and a base rise dimension 144. It will be appreciated that the lengthwise dimension 140 may not necessarily be the longest dimension with respect to the widthwise and base rise dimension 142, 144 respectively. The lengthwise member 120 is coupled to the base 110 via only a base coupling 126. The base coupling 126 is oriented parallel to the lengthwise dimension 140 and substantially medial along the widthwise dimension 142. The positioning of the base coupling 126 creates an I-shape (widthwise dimension 142 vs. base rise dimension 144) between the lengthwise member 120 and the base 110. The horizontal top region of the I-shape is formed by the widthwise dimension 142 of the lengthwise member. The vertical middle region of the I-shape is formed by the base coupling 126. The bottom horizontal region of the I-shape is formed by the base 110 area directly below the lengthwise member 120. The illustrated lengthwise member 120 includes a flexible member 122 and a rigid member 124. It will be appreciated that the rigid member 124 is an optional component which may be used for high strength applications. The flexible member 122 may be composed of a flexible material such as nylon and the rigid member 124 may be composed of a substantially rigid material such as a rubber or plastic composite. The flexible member 122 is wrapped and coupled around the rigid member 124 in a lengthwise configuration. The specific wrapping and coupling configuration of the flexible member 122 may include a stop 130, 132 (see FIG. 4) on one of the lengthwise sides of the lengthwise member 120 that impedes the operational translation of the buckle 160 with respect to the lengthwise member 120 in a coupled configuration. The coupling between the flexible member 122 and the rigid member 124 includes at least one flexible rigid coupling 128. The flexible rigid coupling 128 is oriented parallel to the lengthwise dimension 140 and lateral of the base coupling 126 with respect to the widthwise dimension 142. The flexible rigid coupling 128 extends only through the flexible member 122 and the rigid member 124 and does not extend into the base 110.

Figure 5:
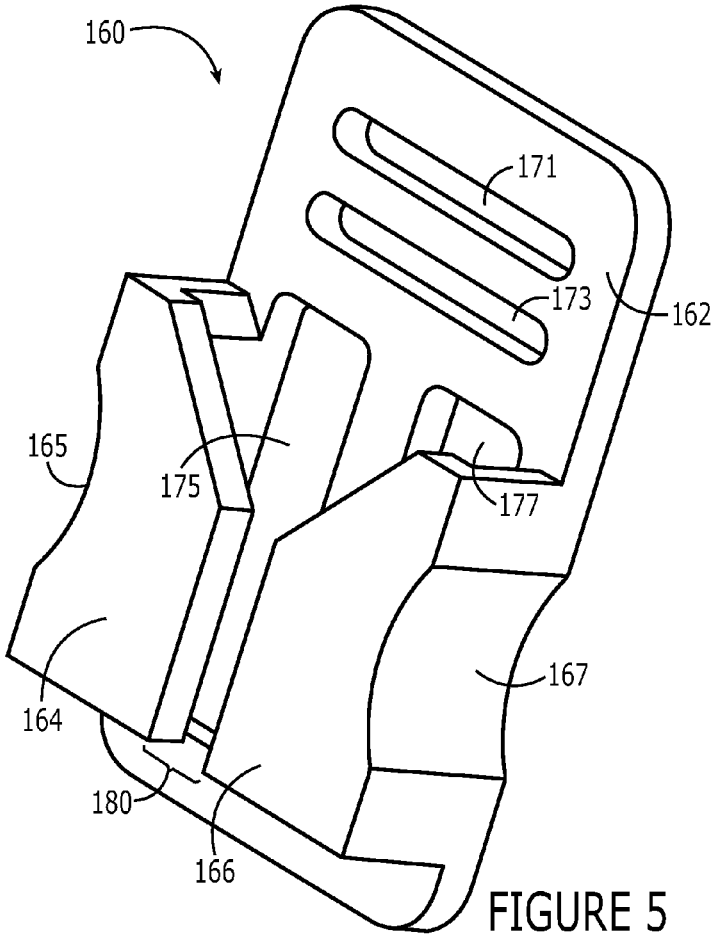
FIG. 5 illustrates a perspective view of the buckle of the releasable coupling system of FIG. 1.
Figure 6:
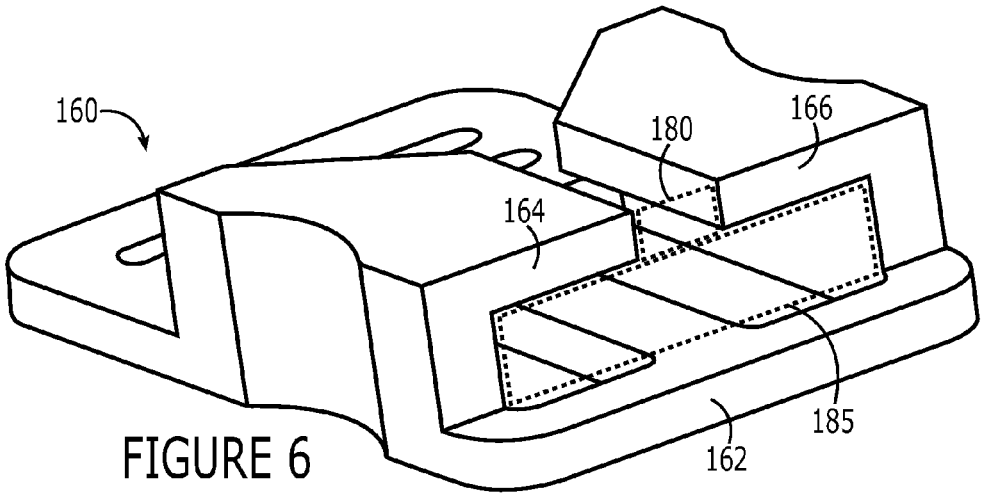
FIG. 6 illustrates a secondary perspective view of the buckle of the releasable coupling system of FIG. 1.

Reference is made to FIGS. 5 and 6 in addition to FIGS. 1-3 to illustrate details about one embodiment the buckle 160. The illustrated buckle 160 is a three dimensional rigid structure including a planar surface 162 and a first and second hooking region 164, 166. The first and second hooking regions 164, 166 extend from the planar surface 162 and are oriented opposite one another. The hooking regions 164, 166 may extend orthogonally from the planar surface 162 as illustrated in FIGS. 1-3, or they may be extend parallel from the planar surface as illustrated in the alternative buckle embodiment illustrated in FIG. 7. The first and second hooking regions 164, 166 each include two orthogonal sub-regions so as to form an L shape. The L-shaped sub-regions of the hooking regions 164, 166 are oriented opposite one another such that the L-shaped regions are facing one another. A gap 180 is formed between the ends of each of the hooking regions 164, 166. The gap 180 is specifically sized to correspond to the width of the base coupling 126 of the lengthwise member to facilitate translation of the buckle 160 with respect to the lengthwise member 120. In addition, the hooking regions 164, 166 are oriented such that the hooking regions 164, 166 are disposed within a widthwise dimension of the planar surface 162. The hooking regions 164, 166 and the planar surface 162 define a partially enclosed region 185. The partially enclosed region 185 is enclosed with the exception of the gap 180 described above. The partially enclosed region 185 is specifically sized to correspond to widthwise dimension 142 and base rise dimension 144 of the lengthwise member 120 to facilitate translation of the buckle 160 with respect to the lengthwise member 120. The hooking regions 164, 166 may further include curved lateral recesses 165, 167. The curved lateral recesses 165, 167 are configured to receive a user's thumb/finger to allow the user to exert the necessary translational force upon the buckle 160 with respect to the lengthwise member 120. The translation of the buckle 160 with respect to the lengthwise member 120 will be described in more detail below with reference to the method of releasable coupling.

The buckle 160 may also include a set of parallel recesses 171, 173 oriented perpendicular to a lengthwise dimension of the buckle 160. The orientation of the parallel recesses 171, 173 facilitates the coupling of a strap 170 to the buckle 160 in a lengthwise orientation. Alternatively, the parallel recesses may be used to couple other types of objects to the buckle, including but not limited to modular members, straps, etc. One alternative buckle 160 coupling scheme will be described with reference to FIG. 11. The buckle 160 may also include secondary recesses 175, 177. The illustrated secondary recesses 175, 177 are oriented parallel to the lengthwise dimension of the buckle 160. The secondary recesses 175, 177 may be used to lower the total weight of the buckle or provide additional coupling options. It will be appreciated that the parallel recesses 171, 173 and the secondary recesses 175, 177 may be oriented in any direction with respect to the buckle 160 to facilitate different coupling orientation.

One non-illustrated application of the system is to form a simplified adjustable securing system. One end of a strap may be routed through the parallel recesses 171, 173 of the buckle, thereby adjustably coupling the strap to the buckle. The opposite end of the strap may be designated as the base 110 upon which the lengthwise member 120 is fixably coupled. Therefore, the buckle 160 may releasably couple the two ends of the strap together and the parallel recesses 171, 173 will enable a user to adjust a looped length of the strap. This application may therefore be used to secure items on a platform by routing the strap around the item and the platform and then tightening the looped length of the strap by extending the strap through the parallel recesses 171, 173.

A second non-illustrated application of the system 100 is to form a multi-location modular soft good system. For example, a garment or backpack may be the base 110 upon which a plurality of lengthwise members 120 is consistent with the embodiments described above. A user may then selectively couple a buckle 160 to any of the lengthwise member. In addition, the user will be able to then translate the buckle 160 with respect to the lengthwise member so as facilitate further selective positioning on the particular soft good item. As described above and below, the buckle 160 may be coupled to various forms of accessories. This type of a modular system is analogous to the operation of the military MOLLE system, which enables users to selectively couple various types of accessories to vests.

In operation, the system 100 illustrated in FIGS. 1-3 may releasably couple the buckle 160 to the base 110 via the lengthwise member 120. FIG. 1 illustrates a decoupled configuration and FIGS. 2-3 illustrate a coupled configuration of the system 100. The buckle 160 may be aligned and/or positioned adjacent to one of the lengthwise ends of the lengthwise member 120. The buckle 160 may also be aligned and/or positioned in alignment with the widthwise dimension 142 of the lengthwise member 120. The positioning of the buckle 160 with respect to the lengthwise member 120 will align the partially enclosed region 185 and the gap 180 with the widthwise dimension 142 and the base coupling 126 of the lengthwise member 120, respectively. The buckle 160 may then be translated parallel to the lengthwise dimension 140 so as to engage the lengthwise member 120 within the buckle 160. This engagement includes routing the widthwise dimension 142 of the lengthwise member 120 within the partially enclosed region 185 of the buckle 160. In addition, the engagement includes routing the base coupling 126 within the gap 180 of the buckle 160. The buckle is thus releasably coupled to the base 110 with respect to a separational force substantially orthogonal to the surface of the base. However, the engagement simultaneously enables the buckle 160 to translate along the lengthwise member parallel to both the lengthwise dimension 140 of the lengthwise member 120 and the surface of the base 110. The opposite lengthwise end of the lengthwise member 120 may include a stop that prevents the buckle 160 from translating beyond the opposite end of the lengthwise member 120 from which the buckle 160 engaged. The stop may include a fold 132 in the flexible member 122 and a stop coupling 134 that extends through the flexible member 122 and the base 110 as illustrated in FIG. 4. Alternatively, the stop may include a fold and some form of surface releasable coupling such as a VELCRO coupling. The buckle 160 may be decoupled from the base 110 and disengaged from the lengthwise member 120 by translating the buckle 160 lengthwise back over the lengthwise end upon which the buckle 160 was initially engaged to the lengthwise member 120. This operational sequence may therefore be used to selectively couple one or more buckles 160 with a base 110 to form a modular system.

Figure 7:
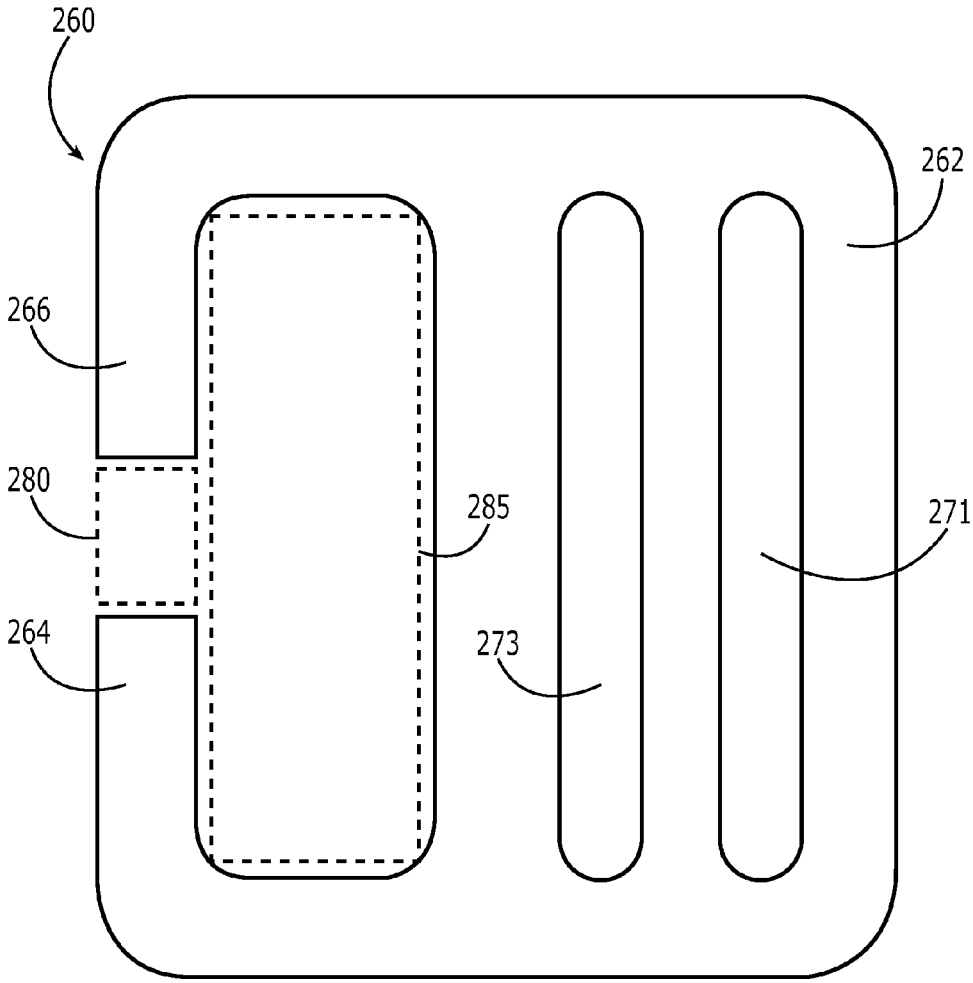
FIG. 7 illustrates a perspective view of an alternative buckle in accordance with embodiments of the present invention.

Reference is next made to FIG. 7, which illustrates a perspective view of an alternative buckle, designated generally at 260. The illustrated alternative buckle 260 may be configured or sized to operate with the lengthwise member 120 illustrated in FIGS. 1-4. The illustrated buckle 260 comprises a single planar surface including both the planar surface 262 and the hooking regions 264, 266. Therefore, the manufacturing of the buckle 260 may be simplified with respect to the buckle 160 embodiment described above. The buckle 260 includes a planar surface 262 which is parallel to the two hooking regions 264, 266. The buckle 260 includes two parallel recesses 271, 273 oriented perpendicular to the lengthwise dimension of the buckle 260. The first and second hooking regions 264, 266 each include two orthogonal sub-regions so as to form an L-shape. The L-shaped sub-regions of the hooking regions 264, 266 are oriented opposite one another such that the L-shaped regions are facing one another. A gap 280 is formed between the ends of each of the hooking regions 264, 266. The gap 280 is specifically sized to correspond to the width of the base coupling 126 of the lengthwise member to facilitate translation of the buckle 260 with respect to the lengthwise member 120. In addition, the hooking regions 264, 266 are oriented such that the hooking regions 264, 266 are disposed within a widthwise dimension of the planar surface 262. The hooking regions 264, 266 and the planar surface 262 define a partially enclosed region 285. The partially enclosed region 285 is enclosed with the exception of the gap 180 described above. The partially enclosed region 285 is specifically sized to correspond to the widthwise dimension 142 and base rise dimension 144 of the lengthwise member 120 to facilitate translation of the buckle 160 with respect to the lengthwise member 120.

Figure 8:
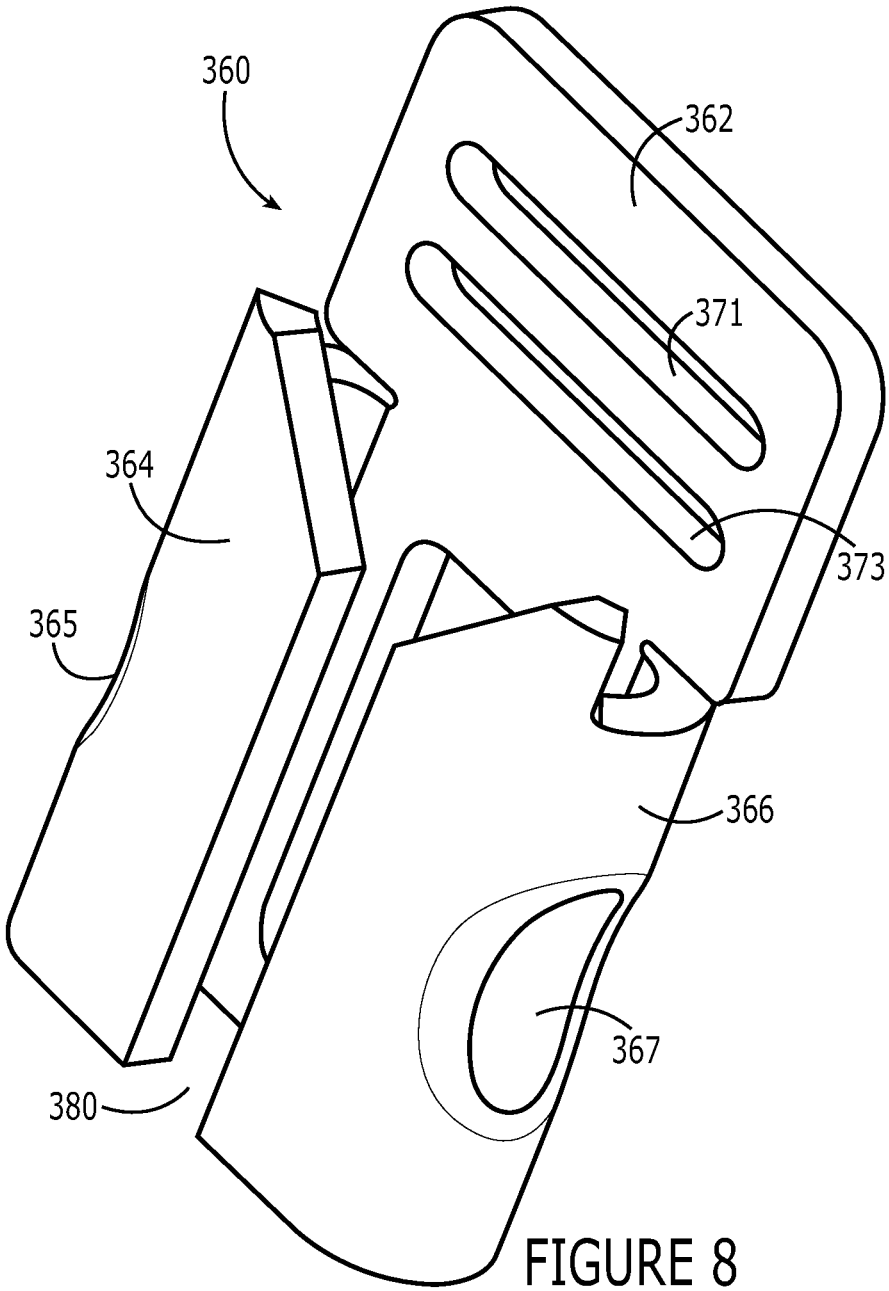
FIG. 8 illustrates a perspective view of a second alternative buckle in accordance with embodiments of the present invention.

Reference is next made to FIG. 8, which illustrates a perspective view of a second alternative buckle, designated generally at 360. The illustrated alternative buckle 360 may be configured or sized to operate with the lengthwise member 120 illustrated in FIGS. 1-4. The illustrated buckle 360 incorporates curved hooking regions 364, 366 which may be advantageous for manufacturing the buckle 360 with sheet metal. The buckle 360 includes two parallel recesses 371, 373 oriented perpendicular to the lengthwise dimension of the buckle 360. The first and second hooking regions 364, 366 each include two orthogonal sub-regions so as to form a C-shape. The C-shaped sub-regions of the hooking regions 364, 366 are oriented opposite one another such that the C-shaped regions are facing one another. A gap 380 is formed between the ends of each of the hooking regions 364, 366. The gap 380 is specifically sized to correspond to the width of the base coupling 126 of the lengthwise member, facilitating translation of the buckle 360 with respect to the lengthwise member 120. In addition, the hooking regions 364, 366 are oriented such that the hooking regions 364, 366 are disposed within a widthwise dimension of the planar surface 362. The hooking regions 364, 366 and the planar surface 362 define a partially enclosed region 385. The partially enclosed region 385 is enclosed except for the gap 380 described above. The partially enclosed region 385 is specifically sized to correspond to the widthwise dimension 142 and base rise dimension 144 of the lengthwise member 120, facilitating translation of the buckle 360 with respect to the lengthwise member 120. The hooking regions 364, 366 may further include curved lateral recesses 365, 367. The curved lateral recesses 365, 367 are configured to receive a user's thumb/finger to allow the user to exert the necessary translational force upon the buckle 360 with respect to the lengthwise member 120.

Figure 9:
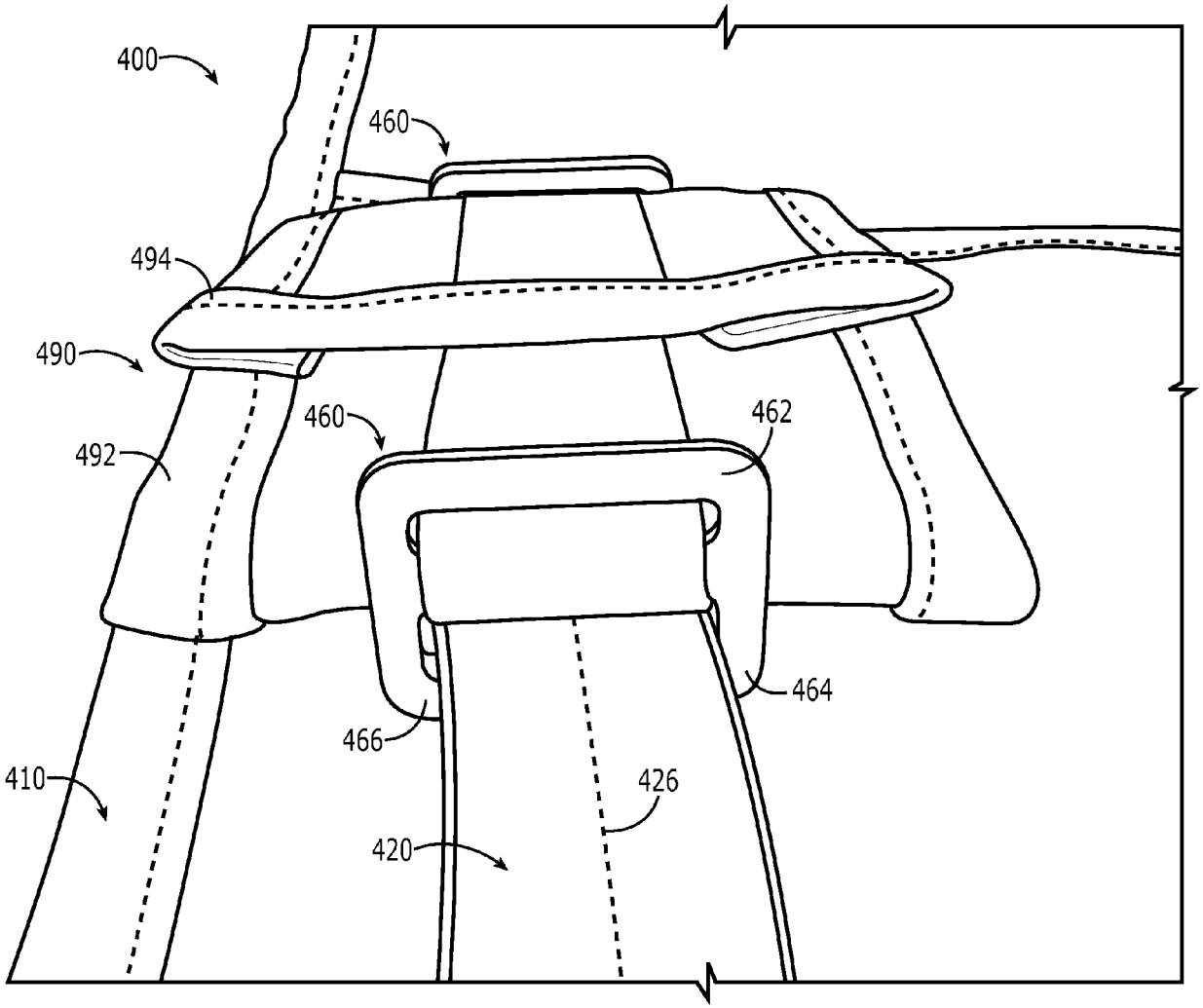
FIG. 9 illustrates a perspective view of an alternative releasable coupling system including the alternative buckle of FIG. 7 in accordance with embodiments of the present invention.

Reference is next made to FIG. 9, which illustrates a perspective view of an alternative releasable coupling system designated generally 400. The system includes a base 410, a lengthwise member 420, and a set of buckles 460. The lengthwise member 420 further includes a base coupling 426. The lengthwise member 420 is analogous to the lengthwise member 120 embodiment described above with respect to FIGS. 1-4. The buckles 460 are coupled on either side of an accessory pouch 490. The accessory pouch 490 further includes a bottom 492 and a flap 494. The coupling between the accessory pouch 490 and the buckles 460 includes routing a strap member through the parallel recess of the buckles 460. It will be appreciated that this type of coupling scheme may be used on various types of accessories including but not limited to pockets, sleeves, pouches, thereby forming a modular system. The illustrated buckles 460 are analogous to the embodiment illustrated in FIG. 7 such that the planar surface is parallel to the hooking regions 464, 466.

The buckles 460 are further illustrated to be releasably coupled to the lengthwise member 420. The releasable coupling between the buckles 460 and the lengthwise member 420 includes attaching the hooking regions of the buckles 460 around the widthwise dimension of the lengthwise member 420. The coupling between the buckles 460 and the lengthwise member 420 also facilitates translating the accessory pouch 490 with respect to the lengthwise member 420. The specific method by which the buckles 460 and the accessory pouch 490 are coupled to the lengthwise member 420 may include the acts described below with reference to the method for releasable coupling.

Figure 10:
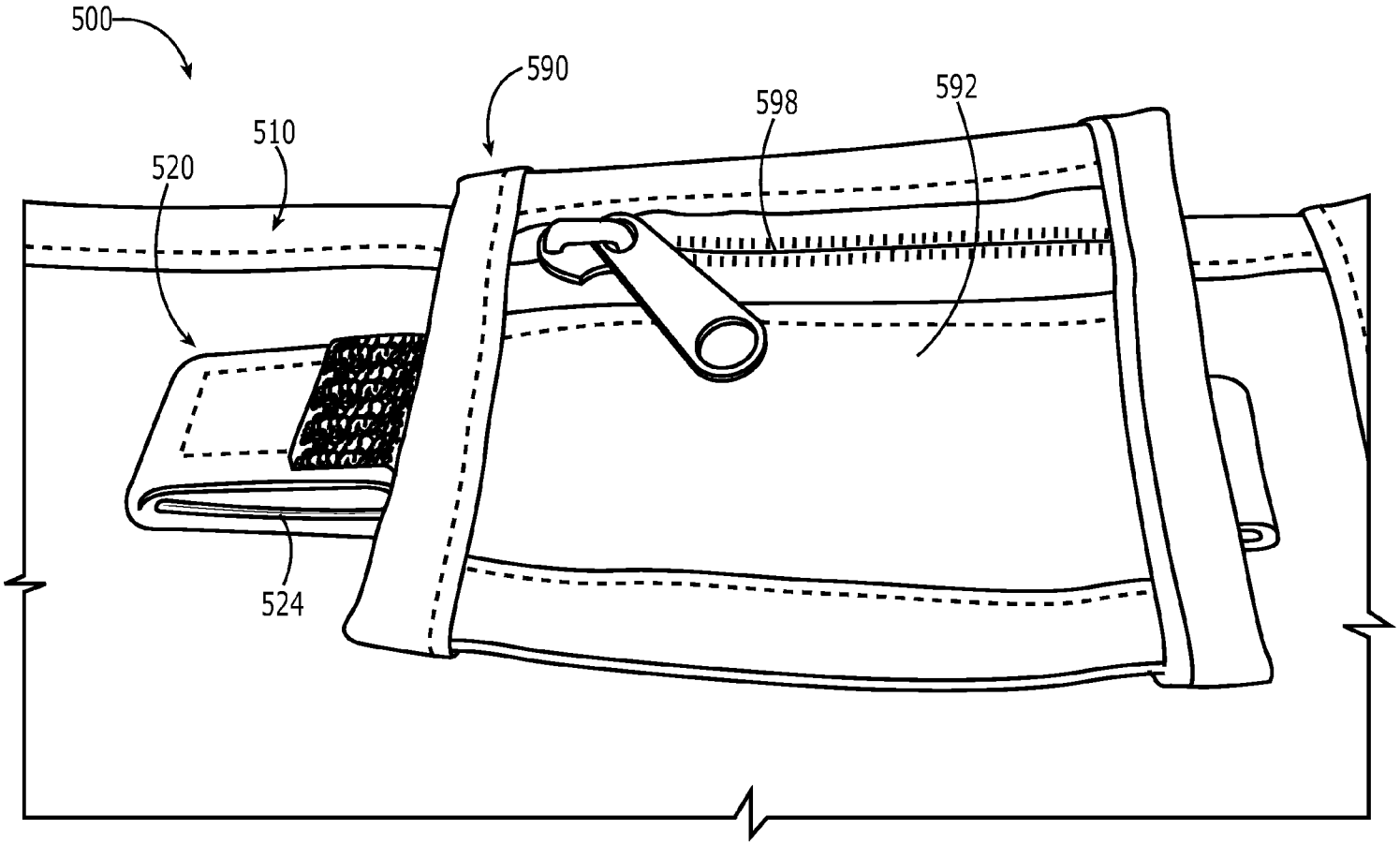
FIG. 10 illustrates a perspective view of an alternative releasable coupling system in accordance with embodiments of the present invention.
Figure 11:
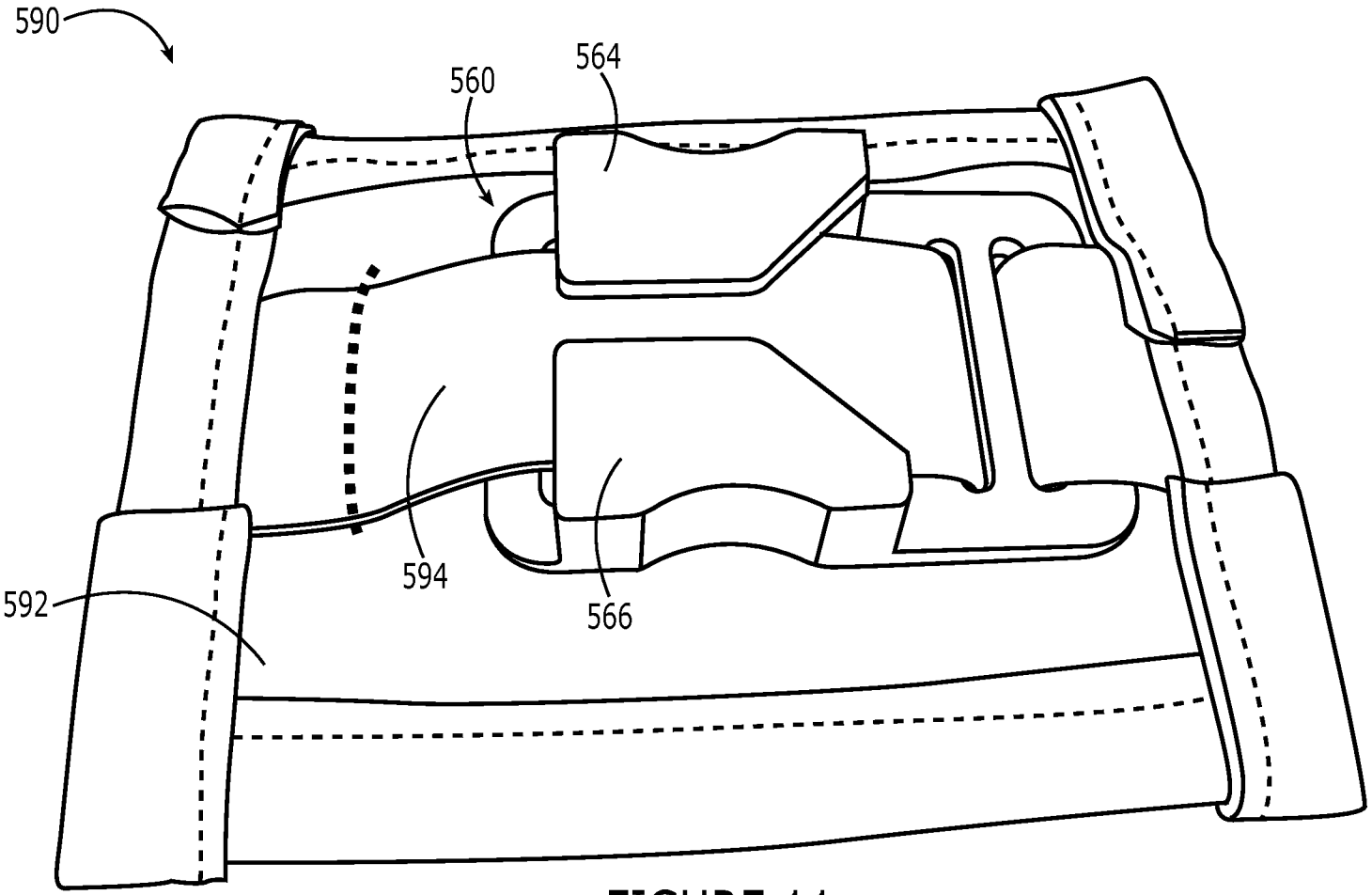
FIG. 11 illustrates a reversed perspective view of components of the releasable coupling system illustrated in FIG. 10 including the buckle of FIGS. 5-6.

Reference is next made to FIGS. 10-11, which illustrates an alternative releasable coupling system, designated generally at 500. The system 500 includes a base 510, a lengthwise member 520, and a buckle 560 (FIG. 11 only). The lengthwise member 520 further includes a flexible member 522 and a rigid member 524. The lengthwise member 420 is analogous to the lengthwise member 120 embodiment described above with respect to FIGS. 1-4. The buckle 560 is further coupled to an accessory pouch 590, which further includes a surface 592, a strap 594, and an opening 598. It will be appreciated that this type of coupling scheme may be used on various types of accessories including but not limited to pockets, sleeves, pouches, thereby forming a modular system.

The buckle 560 is further illustrated to be releasably coupled to the lengthwise member 520. The releasable coupling between the buckle 560 and the lengthwise member 520 includes attaching the hooking regions 564, 566 of the buckle 560 around the widthwise dimension of the lengthwise member 520. The coupling between the buckle 560 and the lengthwise member 520 also facilitates translating the accessory pouch 590 with respect to the lengthwise member 520. The specific method by which the buckle 560 and the accessory pouch 590 are coupled to the lengthwise member 520 may include the acts described below with reference to the method for releasable coupling.

Figure 12:
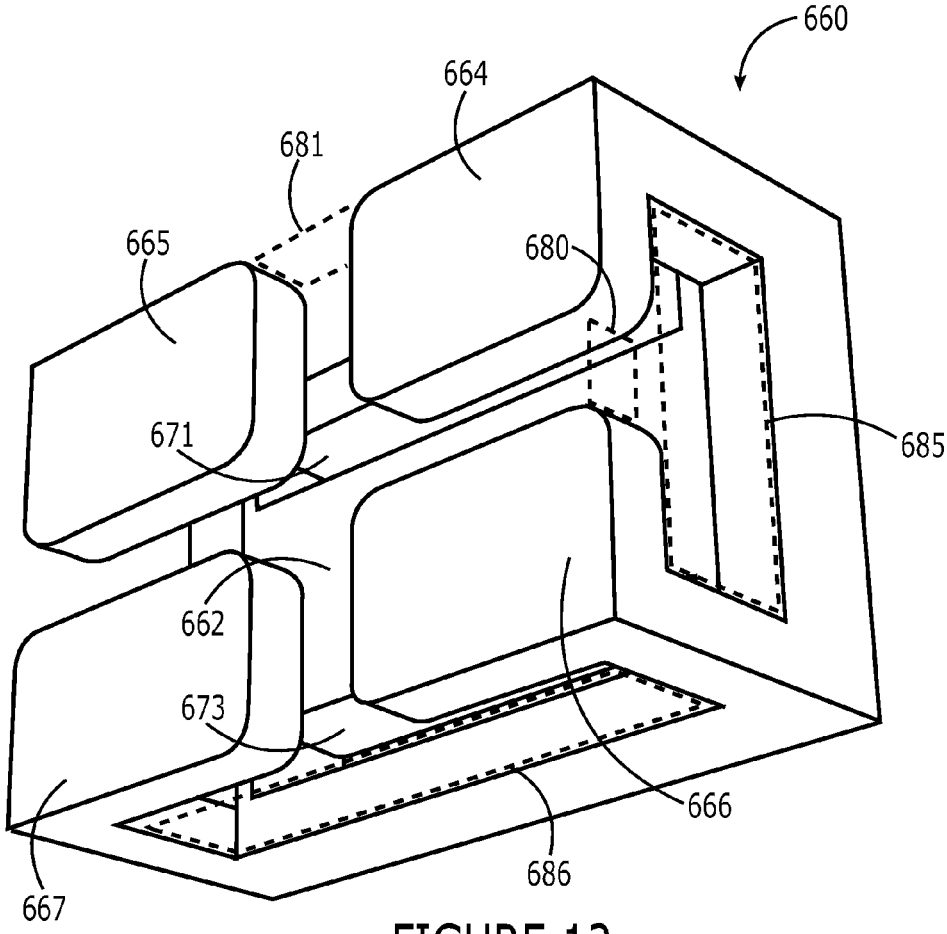
FIG. 12 illustrates a perspective view of an alternative buckle in accordance with embodiments of the present invention.

Reference is next made to FIG. 12, which illustrates an alternative buckle designated generally at 660. The illustrated alternative buckle 660 may be configured or sized to operate with the lengthwise member 120 illustrated in FIGS. 1-4. The buckle 660 is configured to releasably couple with a lengthwise member 120 in two orthogonal orientations. The illustrated buckle 660 is a three dimensional rigid structure including a planar surface 662 and a first, second, third, and fourth hooking region 664, 665, 666, 667. The first, second, third, and fourth hooking regions 664, 665, 666, 667 extend from the planar surface 662 and are oriented opposite one another. The illustrated hooking regions 664, 665, 666, 667 extend orthogonally from the planar surface 662 as illustrated. The first, second, third, and fourth hooking regions 664, 665, 666, 667 each include two orthogonal sub-regions so as to form an L shape. The L-shaped sub-regions of the hooking regions 664, 666 are oriented opposite one another such that the L-shaped regions are facing two of the other respective hooking regions 664, 665, 666, 667. For example, the L-shaped region of the first hooking region 664 is oriented opposite both the second hooking region 665 and the third hooking region 666. A first gap 680 is formed between the ends of each of the first and third hooking regions 664, 666 and the second and fourth hooking regions 665, 667. A second gap 681 is formed between the ends of each of the first and second hooking regions 664, 665 and the third and fourth hooking regions 666, 667. The gaps 680, 681 are specifically sized to correspond to the width of the base coupling of a lengthwise member to facilitate translation of the buckle 660 with respect to the lengthwise member. In addition, the hooking regions 664, 665, 666, 667 are oriented such that the hooking regions 664, 665, 666, 667 are disposed within the lengthwise and widthwise dimension of the planar surface 662. The hooking regions 664, 665, 666, 667 and the planar surface 662 define a first and second partially enclosed region 685, 686. The partially enclosed regions 685, 686 are enclosed with the exception of the gaps 680, 681 as described above. The partially enclosed regions 685, 686 are specifically sized to correspond to a widthwise dimension and base rise dimension of the lengthwise member to facilitate translation of the buckle 660 with respect to the lengthwise member in either a parallel or perpendicular orientation. The buckle 660 also includes a set of parallel recesses 671, 673 within the planar surface 662 oriented parallel to a lengthwise dimension of the buckle 660. The orientation of the parallel recesses 671, 673 facilitates the coupling of a strap to the buckle 660 in a widthwise orientation. Alternatively, the parallel recesses may be used to couple other types of objects to the buckle, including but not limited to modular members, straps, etc. It will be appreciated that the parallel recesses 671, 673 may be oriented in any direction with respect to the buckle 660 to facilitate different coupling orientation.

The system and components described above may be used in conjunction with a method for releasably coupling a buckle to a base. It will be appreciated that analogous acts may be used to releasably decouple a buckle from a base. In addition, the buckle may be coupled to one or more accessories. Therefore, the method may be used to selectively releasably couple the accessories to the base via the buckle. The method includes providing a system with a base, a lengthwise member, and a buckle. The lengthwise member is coupled to the base via a fixed lengthwise coupling parallel to a lengthwise dimension of the lengthwise member and substantially medial with respect to a widthwise dimension of the lengthwise member. The coupling between the lengthwise member and the base may include forming an I-shaped region; wherein the top of the I-shaped region includes the bottom of the lengthwise member; wherein the middle of the I-shaped region includes the coupling between the lengthwise member and the base; and wherein the bottom of the I-shaped region includes the base. The buckle may be positioned adjacent to a lengthwise side of the lengthwise member. The buckle is aligned with the lengthwise and widthwise dimension of the lengthwise member. The buckle is hooked over the lengthwise member, substantially encircling the lengthwise member and forming a gap corresponding to the coupling between the lengthwise member and the base. The hooking of the buckle over the lengthwise member may further include hooking each of two hooking regions on the buckle around each end of the widthwise dimension of the lengthwise member. In a coupled configuration, the buckle may be translated along the lengthwise dimension of the lengthwise member. A strap may be routed through the two parallel recesses on the buckle oriented parallel to the widthwise orientation.

It should be noted that various alternative system designs may be practiced in accordance with the present invention, including one or more portions or concepts of the embodiment illustrated in FIG. 1 or described above. Multiple embodiments may be used in conjunction with a soft good type base as part of larger modular system. In addition, the described system may be used to create a simple releasable strap coupling for applications including but not limited to securing items to a platform. Various other embodiments have been contemplated, including combinations in whole or in part of the embodiments described above.

What is claimed is:

1. A releasable coupling system comprising:

a base;

a lengthwise member coupled to the base having a lengthwise dimension, a widthwise dimension, and a base rise dimension, wherein the only coupling between the lengthwise member and the base is a fixed lengthwise coupling parallel to the lengthwise dimension and substantially medial with respect to the widthwise dimension;

a buckle comprising:

a planar surface having a top and bottom;

a first and second hooked region extending from the planar surface oriented opposite one another; and wherein the first and second hooked regions and the planar surface define a partially enclosed region corresponding to the widthwise dimension and the base rise dimension of the lengthwise member.

2. The system of claim 1, wherein the first and second hooked region extend orthogonally from a bottom planar surface of the planar surface, and wherein the planar surface includes a width corresponding to the widthwise dimension of the lengthwise member.

3. The system of claim 1, wherein the lengthwise member includes a rigid member and a flexible member, and wherein the flexible member is lengthwise wrapped and coupled around the rigid member.

4. The system of claim 3, wherein the coupling between the lengthwise member and the base includes a stitch extending through both the flexible member and the rigid member.

5. The system of claim 3, wherein the coupling between the flexible member and the rigid member includes at least one secondary stitch extending only through the flexible member and the rigid member.

6. The system of claim 1, wherein the coupling between the lengthwise member and the base includes a stitch and wherein the length of the stitch is less than the lengthwise dimension of the lengthwise member.

7. The system of claim 1, wherein the buckle further comprises third and fourth hooked regions extending from the planar surface oriented opposite one another.

8. The system of claim 1, wherein base and lengthwise member form an I-shaped region wherein the top of the I-shaped region includes the bottom of the lengthwise member, and wherein the middle of the I-shaped region includes the coupling between the lengthwise member and the base, and wherein the bottom of the I-shaped region includes the base.

9. The system of claim 1, wherein the first and second hooking region further define a secondary partially enclosed region corresponding to the lengthwise dimension and the base rise dimension of the lengthwise member.

10. The system of claim 1, wherein the first and second hooked regions form a gap corresponding to the coupling between the lengthwise member and the base.

11. The system of claim 1, wherein the planar surface of the buckle includes a set of two parallel recesses.

12. A releasable coupling system comprising:

a base;

a lengthwise member externally coupled to the base having a lengthwise dimension, a widthwise dimension, and a base rise dimension, wherein the only coupling between the lengthwise member and the base is a fixed lengthwise coupling parallel to the lengthwise dimension and substantially medial with respect to the widthwise dimension;

a buckle comprising:

a planar surface having a top and bottom;

a first and second hooked region extending from the planar surface oriented opposite one another; and wherein the first and second hooked regions and the planar surface define a partially enclosed region corresponding to the widthwise dimension and the base rise dimension of the lengthwise member, and wherein the partially enclosed region includes a gap corresponding to the coupling between the lengthwise member and the base.

13. A method for releasably coupling a buckle to a base comprising the acts of:

providing a base, a lengthwise member, and a buckle;

independently coupling the lengthwise member to the base only via a fixed lengthwise coupling parallel to a lengthwise dimension of the lengthwise member and substantially medial with respect to a widthwise dimension of the lengthwise member, wherein the coupling defines a base rise separation between the lengthwise member and the base;

aligning the buckle with the lengthwise and widthwise dimension of the lengthwise member; and hooking the buckle over the lengthwise member substantially encircling the lengthwise member and forming a gap corresponding to the coupling between the lengthwise member and the base;

wherein the buckle further includes two hooked regions which together form a partially enclosed region corresponding to the base rise separation.

14. The method of claim 13 further includes the act of positioning the buckle adjacent to a lengthwise side of the lengthwise member.

15. The method of claim 13, wherein the act of coupling the lengthwise member to the base via a fixed lengthwise coupling parallel to a lengthwise dimension of the lengthwise member and substantially medial with respect to a widthwise dimension of the lengthwise member further includes forming an I-shaped region; wherein, the top of the I-shaped region includes the bottom of the lengthwise member, and wherein the middle of the I-shaped region includes the coupling between the lengthwise member and the base, and wherein the bottom of the I-shaped region includes the base.

16. The method of claim 13, wherein the act of hooking the buckle over the lengthwise member substantially encircling the lengthwise member and forming a gap corresponding to the coupling between the lengthwise member and the base further includes hooking each of two hooking regions on the buckle around each end of the widthwise dimension of the lengthwise member.

17. The method of claim 13 further includes the act of translating the buckle along the lengthwise dimension of the lengthwise member.

18. The method of claim 13 further includes routing a strap through two parallel recesses on the buckle oriented parallel to the widthwise orientation.

19. The method of claim 13, wherein the lengthwise member further includes a rigid member and a flexible member, and wherein the flexible member is lengthwise wrapped and coupled around the rigid member.

20. The method of claim 13, wherein the buckle further includes a planar surface and two hooked regions which together form a partially enclosed region corresponding to the widthwise dimension of the lengthwise member.

* * * * *